US008181366B2

(12) United States Patent
Sartor et al.

(10) Patent No.: US 8,181,366 B2
(45) Date of Patent: May 22, 2012

(54) SKI BOOT, IN PARTICULAR FOR SKI MOUNTAINEERING

(75) Inventors: Mario Sartor, Volpago Del Montello (IT); Piero Fenato, Caerano di San Marco (IT)

(73) Assignee: Ober ALP S.p.A., Bolzano (IT)

( * ) Notice: Subject to any disclaimer, the term of this patent is extended or adjusted under 35 U.S.C. 154(b) by 380 days.

(21) Appl. No.: 12/453,416

(22) Filed: May 11, 2009

(65) Prior Publication Data

US 2009/0277045 A1 Nov. 12, 2009

(30) Foreign Application Priority Data

May 9, 2008 (IT) ..... VE2008A0040

(51) Int. Cl.
*A43B 5/04* (2006.01)
*A43B 5/16* (2006.01)

(52) U.S. Cl. ..... 36/117.1; 36/117.4; 36/118.5; 36/119.1

(58) Field of Classification Search ..... 36/117.1, 36/117.2, 117.4, 72 R, 118.2, 118.5, 118.6, 36/119.1, 77 R, 77 M
See application file for complete search history.

(56) References Cited

U.S. PATENT DOCUMENTS 4,280,286 A * 7/1981 Sartor ..... 36/118.9
4,611,415 A * 9/1986 Tonel ..... 36/115
4,615,128 A * 10/1986 Borsoi ..... 36/118.7
4,756,099 A * 7/1988 Walkhoff ..... 36/118.8
4,825,566 A * 5/1989 Sartor ..... 36/117.8
4,841,650 A * 6/1989 Dodge et al. ..... 36/117.7
4,920,666 A * 5/1990 Marega ..... 36/117.1
5,171,033 A * 12/1992 Olson et al. ..... 280/11.202
5,228,219 A * 7/1993 Tonel ..... 36/50.1
5,272,823 A * 12/1993 Perrissoud ..... 36/117.7
5,551,174 A * 9/1996 Perrissoud ..... 36/50.5
5,592,758 A * 1/1997 Iwama et al. ..... 36/117.1
5,596,820 A * 1/1997 Edauw et al. ..... 36/115
5,608,976 A 3/1997 Marega et al.
5,746,016 A * 5/1998 Freisinger et al. ..... 36/117.1
5,921,006 A * 7/1999 Vargas, III ..... 36/118.2
6,247,252 B1 6/2001 Parisotto
6,588,125 B2 * 7/2003 Proctor, Sr. ..... 36/117.1
6,671,982 B2 * 1/2004 Caeran ..... 36/117.1
6,708,425 B2 3/2004 Parisotto
7,231,729 B2 * 6/2007 Heierling et al. ..... 36/118.2

* cited by examiner

*Primary Examiner* — Khoa Huynh
*Assistant Examiner* — Melissa Lalli
(74) *Attorney, Agent, or Firm* — Themis Law

(57) ABSTRACT

A ski boot for ski mountaineering or telemark skiing including a shell of plastic material and a sole. A first longitudinal cut in the shell defines two sides which allow the entry of the foot of the skier. A second cut in the shell, transverse to, and opening into the first cut, is formed in the front section of the shell. The first and second cuts form a longitudinal slot in the shell; stops are located at opposite ends of the slot. In the preferred embodiment, a peg with an enlarged head is slit within the slot to adjust the flexibility of the boot in the longitudinal direction. In the alternative embodiment, a gaiter and a profiled element are located in the area of the first cut and the second cut in the shell. A peg with an enlarged head is slid with aligned slots in the shell, gaiter, and profiled element, to adjust the flexibility of the shell in the longitudinal direction.

12 Claims, 6 Drawing Sheets

SKI BOOT, IN PARTICULAR FOR SKI MOUNTAINEERING

FIELD OF THE INVENTION

The present invention relates to a ski boot, in particular for ski mountaineering.

BACKGROUND OF THE INVENTION

Ski boots are known comprising an outer shell of plastic material, a sole, a leg portion pivoted to the shell on bosses provided at the malleoli, a padded inshoe, and a plurality of closure hooks, laces, latches, etc. to immobilize the skier's let within the shell.

The shell generally presents a flexible portion (bellows0 in the region straddling the metatarsus of the foot, enabling the skier to bend the leg during walking.

To illustrate, U.S. Pat. No. 6,247,252, granted Jun. 19, 2001 to David Parisotto, discloses a telemark ski boot which possesses the desired characteristics of torsional rigidity, without penalizing flexibility in the area of the metatarsus. Such flexibility allows the skier to raise his, or her, heel, when facing a curve in his path, as contrasted with the rigid fastening of the heel to the ski, in the conventional skiing technique.

The flexibility in the ski boot of Parisotto '542 is achieved by flexible portion 11 , which extends transversely across the shell of the boot, as shown in FIGS. 1 and 3. The flexible portion presents an undulated profile defined by a pair of grooves 12 separated by an intermediate rib 12*a*. Stiffening elements 17, 18 join the inner sole of the shell, immediately behind the flexible portion, to maintain torsional rigidity of the ski boot, without interfering with the flexibility of the shell. The shell and the flexible portion of the ski boot may be formed from different plastics, with different levels of flexibility; a co-injection process is suggested.

U.S. Pat. No. 6,708,425, granted Mar. 23, 2004, to David Parisotto, discloses a ski boot, comprising a plastic shell, a shank or leg portion hinged to the shell for pivotal movement relative thereto, and a control mechanism, located at the rear of the boot, for controlling the tilt of the shank relative to the shell. A flexible portion 11, extending across the boot in the vicinity of the metatarsus, is formed by two grooves 12 separated by a radiused intermediate portion 12*a*. The ski boot is suitable for use as a ski-mountaineering boot, or a telemark skiing boot, as noted in column 1, lines 21-41, of Parisotto '425.

However, these known ski boots represent certain drawbacks. In particular, possible accidental release of the front jaw and/or heel fixing unit from the binding, as the heel and toe of the boot tend to rise following boot flexure/deformation; weakening of the boot structure under torsional stresses, i .e. those stresses induced by guiding the ski; and difficulties in manufacturing and assembling the boots as the bellows are made separately from the shell, and must be inserted into the boot injection mold. This procedure also requires the shell to be closed at the rear of the region in which the bellows are applied. This requirement leads to difficulty in removing the boot from the mold and makes it necessary to use materials of low rigidity, which contribute to poor technical performance.

BRIEF SUMMARY OF THE INVENTION

An object of the invention is to provide a boot which enables the skier's leg to bend while comprising a shell moldable with high rigidity material.

Another object of the invention is to provide a boot, the shell of which resists torsional stresses.

Another object of the invention is to provide a boot including a rigid plastic shell that receives two cuts, in strategic locations near the front of the shell, during the manufacturing process. The first, or longitudinal cut, defines the sides of the boot in the aperture that receives the wearer's foot. Second cuts, transverse to the longitudinal cut, for V-shaped recesses in the metatarsal area of the wearer's foot. A longitudinal slot is formed in the boot to increase flexibility in the metatarsal area.

Furthermore, a rotatable peg, with an enlarged head, is moved, within the slot, by manually adjusting same. The adjustment of the peg alters the extent, or degree, of flexibility in the longitudinal dimension of the shell and boot. Such adjustment enables the wearer of the boot to better adapt same to different terrains, and ground conditions, encountered while wearing applicant's ski boot.

In the alternative embodiment of applicant's boot, a gaiter and a protective plate, with a carbon fiber coating, are positioned in the depression in the shell formed by the intersecting cuts. Aligned slots are formed in the gaiter, and the protective plate, and a rotatable peg, or rivet, is moved, within the slots, to alter the degree of flexibility of the shell in the longitudinal direction.

A unique method of forming the shell is disclosed, in both embodiments, of applicant's boot. The desired degree of flexibility, in the longitudinal direction, is achieved without report to transverse bellows in the front section of known ski boots. Applicant's method is superior to known production and assembly techniques, yet yields superior results.

These and other objects which will be apparent from the ensuing description of applicant's ski boot, as described hereinafter.

BRIEF DESCRIPTION OF THE DRAWINGS

The present invention is further clarified hereinafter with reference to the accompanying drawings, in which.

DETAILED DESCRIPTION OF THE INVENTION

Figure 1:
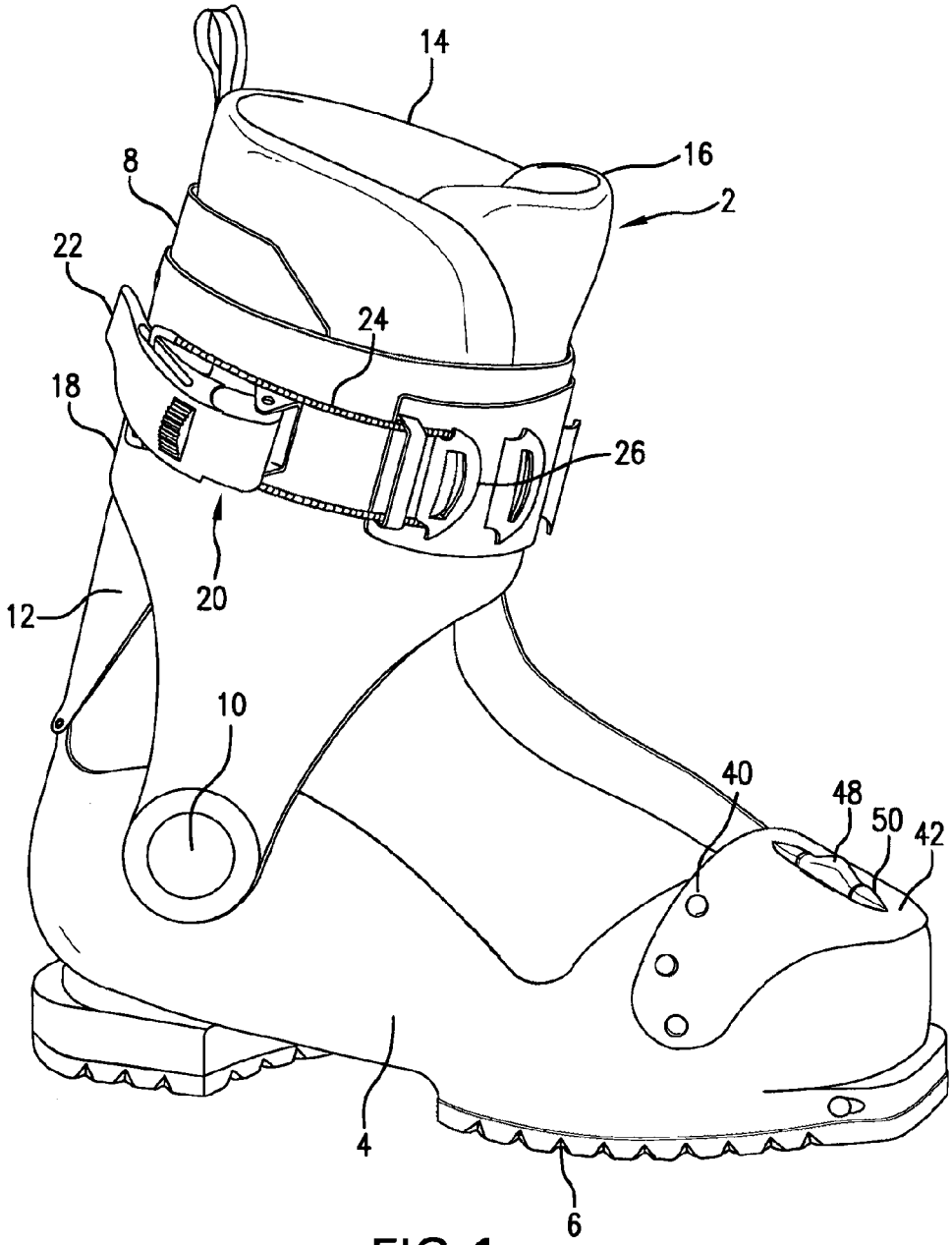
FIG. 1 is a perspective view of a ski boot according to the invention.
Figure 2:
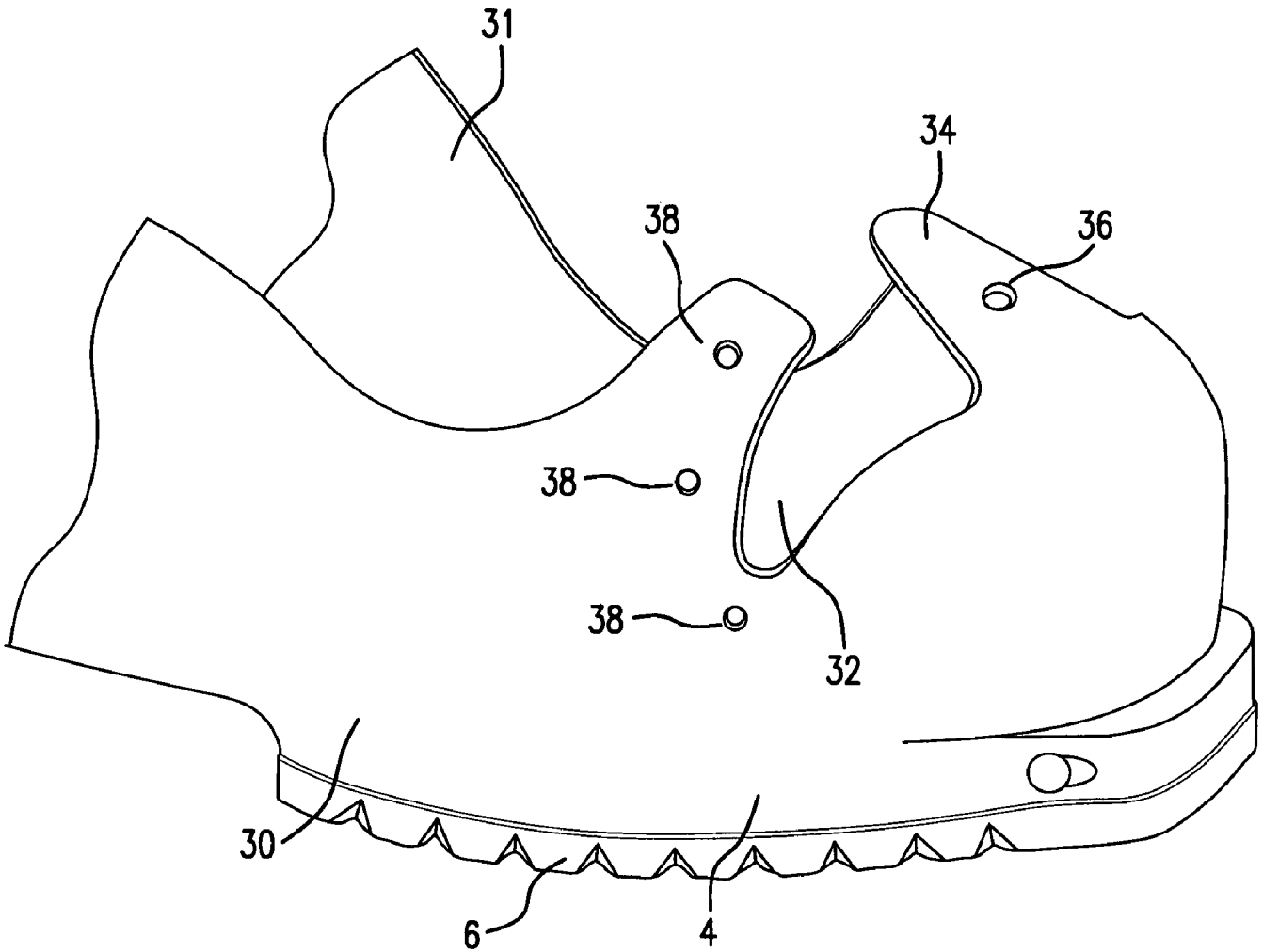
FIG. 2 shows the front half of the boot shell in a perspective view.

As can be seen from the figures, the ski boot of the invention is indicated overall by 2 and can be either a mountaineering ski boot or a telemark ski boot.

The boot comprises a shell 4 of rigid plastic or composite material, a sole 6, a leg portion 8 of plastic or composite material pivoted to the shell on bosses 10 provided at the malleoli, and a spoiler 12 pivoted to the rear of the shell and wrapped by the leg portion 8.

Inside the shell traditional padded inshoe 14 is inserted into the shell. Inshoe 14 is provided with a tongue 16.

On one side 18 of the leg portion 8, a coupling device indicated overall by 20 is mounted, comprising a lever 22 for operating a traction ring 24 selectively engageable in one of a plurality of coupling elements 26 provided on the other side of the leg portion 8.

The shell is provided with a longitudinal cut 31 defining two sides 30, each provided in the metatarsal region with a V-shaped recess 32 defining, with the toe of the shell, a central flap 34 provided with a hole 36. Cut 31 extends to the toe of the boot.

Further, holes 38 are provided in the shell 4 to be engaged by rivets 40, as shown in FIG. 1, for fixing a stiffening plate 42 of rigid plastic or composite material. The plate 42 is provided with a longitudinal slot 44. A rotatable peg 46 is inserted into slot 44 and also passes through the hole 36. Peg 46 is provided with a substantially parallelepiped head 48 corresponding in length to the distance between two stops 50 provided on the outer surface of the plate 42.

The operation of the boot of the invention is conventional, such that when the skier has inserted his, or her, foot into the shell 4, the traction ring 24 is engaged with one of the coupling elements 26, and the lever 22 is operated in the direction which causes the two sides of the leg portion 8 to approach each other.

The V-shaped recesses 32 provided in the boot metatarsal region allow the boot to bend easily during walking.

At the same time, the plate 42 has the effect of blocking any torsional stresses on the boot during descent.

Figure 3:
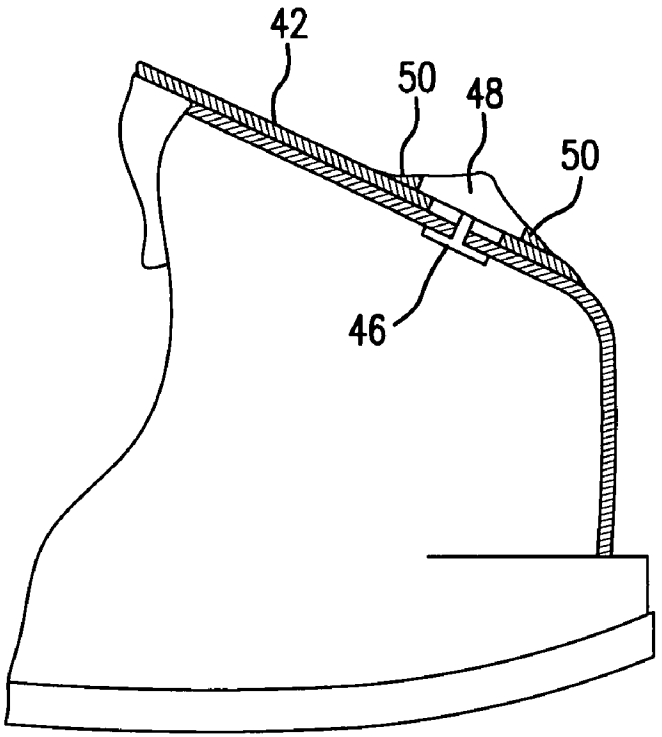
FIGS. 3 and 4 are longitudinal sections through the front region of the boot.
Figure 4:
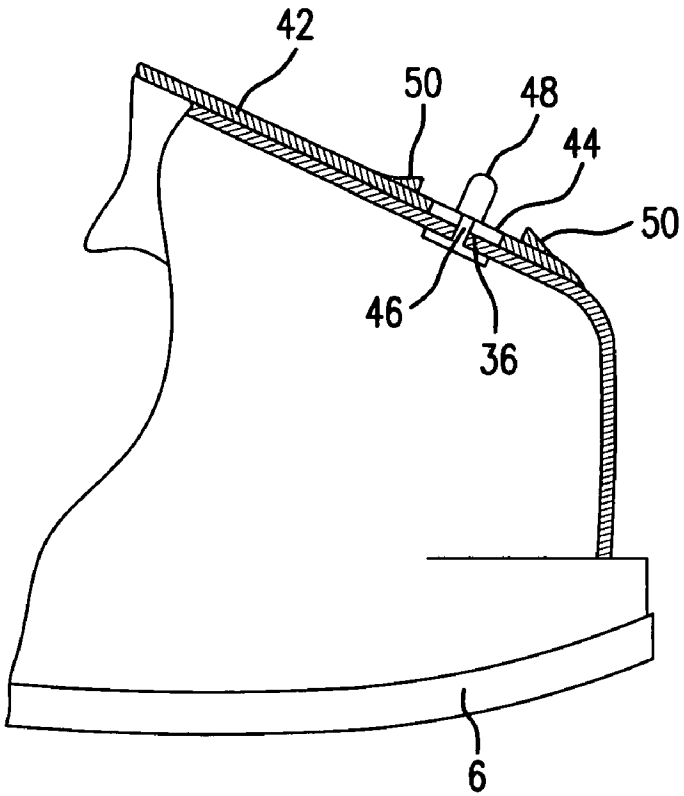

With regard to the rotatable peg 46 with head 48, the pin can be positioned in the configuration indicated in FIGS. 3 and 4, and in particular when the peg 46 is positioned with the head 48 disposed between the two stops 50 (see FIG. 3), the peg 46 is unable to travel along the slotted hole and bending is therefore prohibited (descent condition); when the peg 46 is rotated to a position perpendicular to stops 50 (see FIG. 4), the peg 46 is moved within slot 44 enable the boot to bend (walking condition).

Figure 5:
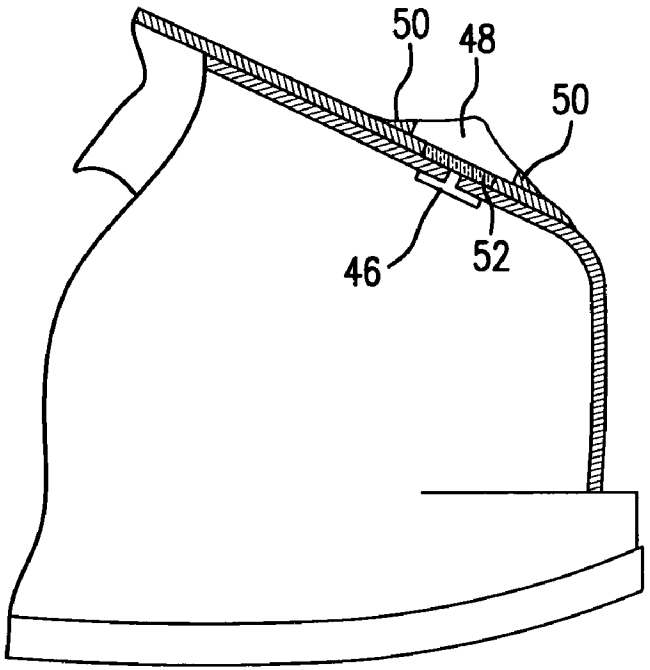
FIGS. 5 and 6 show a variant thereof in the same views as FIGS. 3 and 4.
Figure 6:
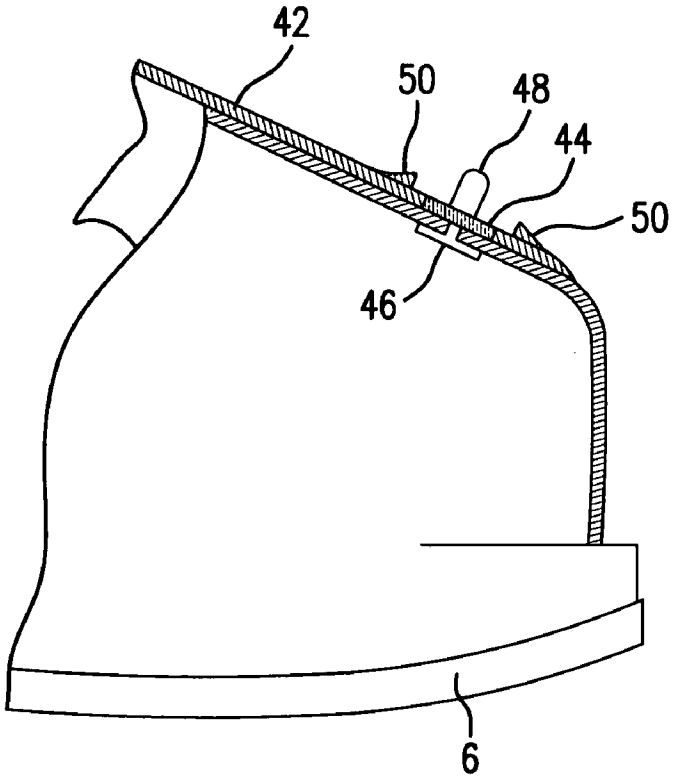
Figure 8:
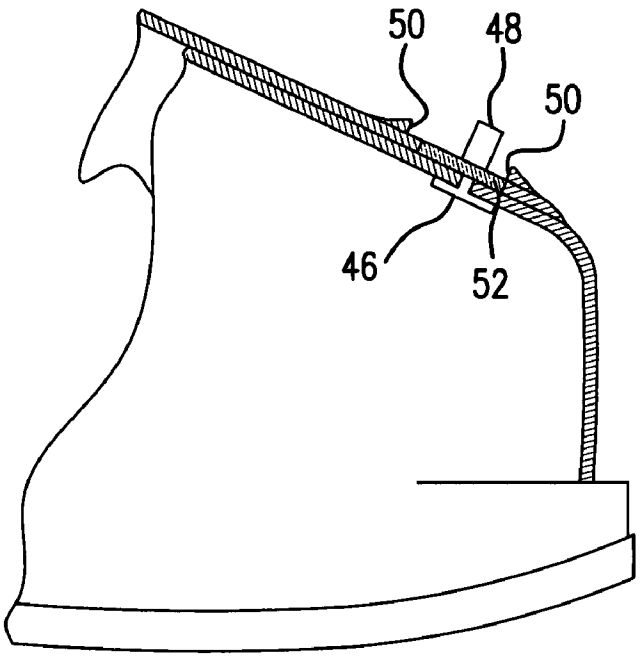
FIGS. 7 and 8 show the embodiment of FIGS. 5 and 6 while undergoing forward bending and rearward bending.
Figure 7:
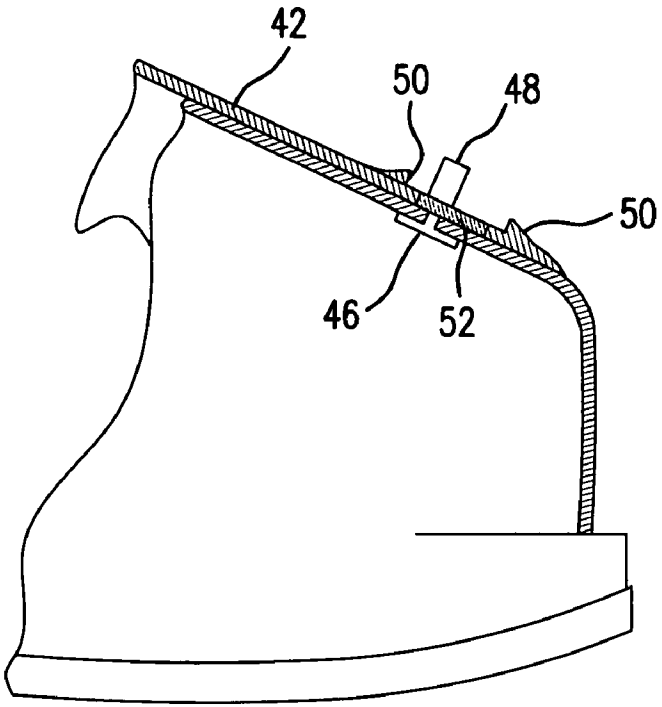
Figure 11:
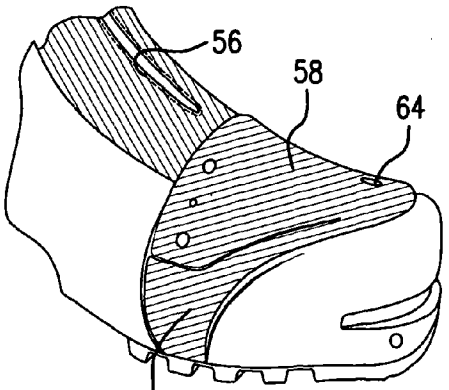
FIGS. 9-13 show the steps involved in preparing a ski boot for ski mountaineering according to the invention, in an improved embodiment.
Figure 10:
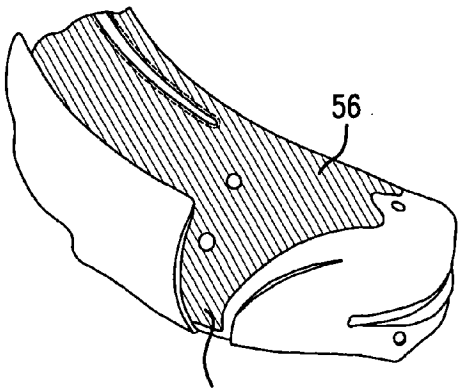
Figure 9:
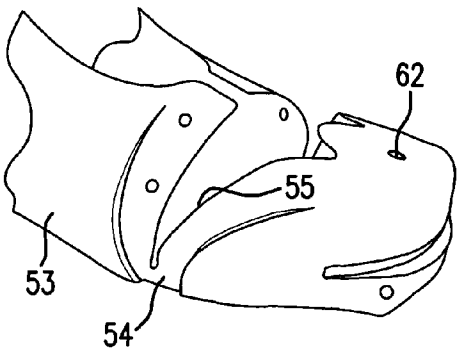
Figure 13:
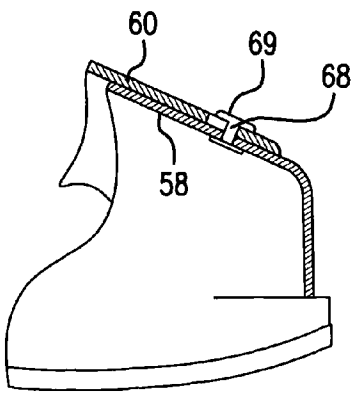
Figure 12:
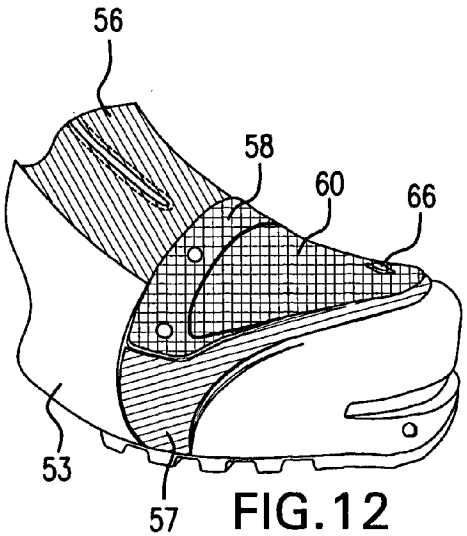

In the embodiment shown in FIGS. 5 and 6, a disc 52 of elastomeric material is operatively associated with peg 46 limits the travel of peg 46 and consequently the boot flexure.

From the foregoing, it is apparent that the ski boot of the invention presents numerous advantages, and in particular it can be constructed of rigid material not only because the damping element (disc 52), is applied after its construction, but also because a deep recess 32 can be formed in the shell to enable it to be easily removed from the mold, and peg 46 with head 48 can be adjusted within longitudinal slot 44, to regulate the degree of flexure over a wide range. At one extreme, head 48 of pin 46 engages stops 50 at opposite ends of slot 44, and flexure of the boot is reduced to zero.

FIGS. 9-13 show the steps involved in preparing a ski boot for ski mountaineering according to the invention, in an improved, alternative embodiment.

Specifically, the side walls of the shell 53 are provided with a slight depression 54 in the area of the V-shaped transverse cut, or slot, 55.

The resultant shell is fitted with a plastic gaiter 56 with its lateral appendices, or flaps 57, housed in the depression 54. Gaiter 56 performs a sealing function and provides further stiffening along the longitudinal axis of the shell 53 during forward and rearward bending of the skier's leg (see FIG. 10).

A rigid plastic profiled element 58 (see FIG. 11) is secured to gaiter 56, and covering 60 is applied (see FIG. 12) over profiled element 58 to further strengthen the structure.

In the alternative, the shell is provided with a slot 62 aligned with slots 64, 66 of FIGS. 9-13, provided in the profiled element 58 and in the covering 60, respectively. Peg 68, with an enlarged head 69, passes through the aligned slots. Peg 68 may be fixed within the slots, or may be moved longitudinally within the slots to alter the degree of flexure in shell 53 of the ski boot.

Other modifications and revisions may occur to the artisan after consideration of the application. Hence, the appended claims should be broadly construed in a manner consistent with applicant's contribution to ski boot production, and operation, and the claims should not be limited to their specific terms.

What is claimed is:

1. A ski boot adapted for ski mountaineering, said boot comprising a shell;

a sole;

a leg portion, said shell being provided with a first cut extending longitudinally toward a toe portion of the ski boot and defining two sides laterally spaced one from the other and defining a foot entry aperture, and at least one second cut defining a cavity in said shell that extends laterally from said first cut;

a stiffening plate coupled to said shell and positioned to substantially cover said at least one second cut and to partially overlap said first cut, said stiffening plate being provided with a longitudinal slot overlapping a hole in the toe portion, and a rotatable peg inserted through said longitudinal slot and said hole, said rotatable peg having a head of substantially parallelepiped shape of a length corresponding to a distance between two stop appendices provided on an outer surface of the plate on opposite sides of said longitudinal slot, wherein flexing of a foot of a skier is prevented when said head is aligned longitudinally between said two stop appendices, and wherein the flexing of the foot is enabled when the rotatable peg translates within the longitudinal slot such that the head is disposed laterally from said two stop appendices.

2. The ski boot as claimed in claim 1, wherein the at least one second cut defines a pair of cavities in the shell that extend transversely across said shell perpendicular to the first cut.

3. The ski boot as claimed in claim 2, wherein said cavities are V-shaped.

4. The ski boot as claimed in claim 1, wherein said first cut terminates at the toe portion of the shell, and said at least one second cut is provided in a metatarsal region of the shell.

5. The ski boot as claimed in claim 1, wherein said plate is coupled to the shell by rivets simultaneously engaging corresponding holes provided in said shell and in said stiffening plate.

6. The ski boot as claimed in claim 2, wherein said first cut and said cavities define, within the toe portion of the shell, a central flap provided with the hole.

7. The ski boot as claimed in claim 1, further including an element of damping material inserted into said longitudinal slot, said element fitting about said rotatable peg.

8. The ski boot as claimed in claim 1, further comprising a gaiter of flexible material disposed in a position below the stiffening plate.

9. The ski boot as claimed in claim 8, further including a rigid plastic element that is interposed between said stiffening plate and said gaiter of flexible material.

10. A ski boot adapted for ski mountaineering, said boot comprising:

a) a rigid plastic shell with a sole configured to support a foot of a skier;

b) a leg portion configured to fit about a leg of the skier;

c) bosses disposed on an exterior portion of said shell;

d) recesses on an interior portion of said shell configured to receive the bosses and allow said leg portion to pivot relative to said shell;

e) a first cut extending longitudinally and formed in an upper portion of said shell to define an aperture for receiving the foot of the skier, said first cut laterally spacing opposing portions of said shell;

f) at least a second cut extending transversely across said shell to define a cavity therein, and opening into said first cut;

g) a stiffening plate coupled to said shell and partially covering said first cut and substantially covering said at least a second cut, said stiffening plate being provided with a longitudinal slot overlapping a hole in said shell, and h) a rotatable peg inserted through said longitudinal slot and said hole, said rotatable peg having a head of substantially parallelepiped shape of a length corresponding to a distance between two stop appendices provided on an outer surface of the plate on opposite sides of said slot, wherein flexing of a foot of a skier is prevented when said head is aligned longitudinally between said two stop appendices, and wherein the flexing of the foot is enabled when the rotatable peg translates within the longitudinal slot such that the head is disposed laterally from said two stop appendices.

11. The ski boot as claimed in claim 10, wherein said at least a second cut defines two or more cavities formed in said shell and disposed transverse to said first cut.

12. The ski boot as claimed in claim 10, wherein said first cut extends longitudinally through said shell, but stops short of a toe of said ski boot.

* * * * *